United States Patent [19]

Lewallyn

[11] 4,135,321

[45] Jan. 23, 1979

[54] FIRING NIPPLE

[76] Inventor: Michael Lewallyn, P.O. Box 1361, Dalton, Ga. 30720

[21] Appl. No.: 890,383

[22] Filed: Mar. 27, 1978

[51] Int. Cl.[2] ..... F41C 27/00

[52] U.S. Cl. ..... 42/83

[58] Field of Search ..... 42/83, 51, 90

[56] References Cited

U.S. PATENT DOCUMENTS

| | | | |
|---|---|---|---|
| 6,139 | 2/1849 | Minesinger | 42/83 |
| 16,503 | 1/1857 | Ward | 42/83 |
| 25,664 | 10/1859 | Maynard | 42/83 |
| 28,667 | 6/1860 | Lord | 42/83 |
| 60,791 | 1/1867 | Rowe | 42/83 |

*Primary Examiner*—Charles T. Jordan

*Attorney, Agent, or Firm*—Jones, Thomas & Askew

[57] ABSTRACT

A firing nipple for use in muzzle loaded firearms comprises a duct of large internal diameter into which a cartridge shaped percussion cap can be inserted and a firing ridge against which the rim of the cartridge shaped cap is forced to ignite the cap.

2 Claims, 2 Drawing Figures

Fig. 2
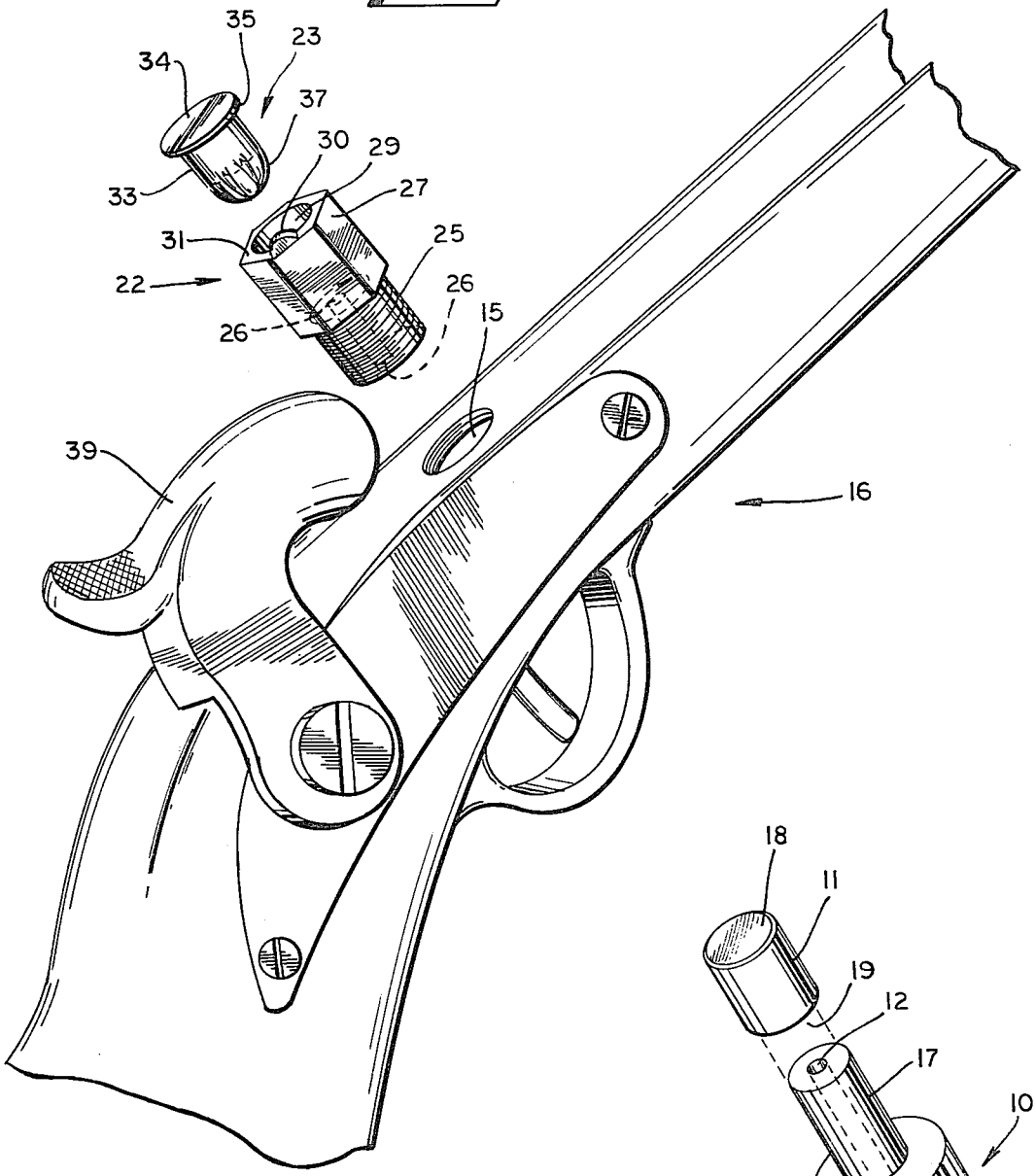
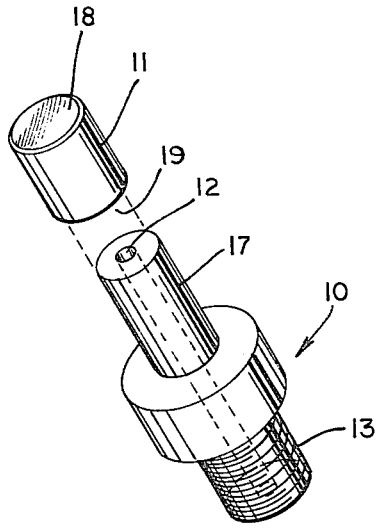
Fig. 1
PRIOR ART

FIRING NIPPLE

BACKGROUND

This invention relates to a firing nipple for use in muzzle loaded firearms. Over the last several years, the sport of hunting and shooting with muzzle loading guns has become popular. The most popular type of gun for hunting is the percussion type which utilizes a bucket-shaped percussion cap pressed upside down over a nipple. The nipple associated with this prior bucket-shaped cap is a removable hollow tube which protrudes from inside the firing or powder chamber of the gun. The protruding end of the nipple is exposed to the gun hammer and the bucket-shaped cap fits over this exposed end of the nipple. The percussion cap contains a small quantity of gun powder and upon impact by the hammer falling, the cap is forced against the nipple, the cap powder is ignited, and fire is forced through the hollow passage of the nipple into the black powder charge in the barrel. The resulting explosion forces the bullet from the barrel.

The existing bucket-shaped percussion caps are very fragile and the cap powder is easily deteriorated by water because the powder is exposed to the atmosphere in the unsealed "bucket". On wet days, misfires often occur.

SUMMARY OF THE INVENTION

The problem of water damaged bucket-shaped percussion caps is remedied by the present invention by the use of a waterproof percussion cap which is sized and shaped similar to the rear portion of a rimmed 22 caliber cartridge. The new waterproof cap has a cylindrical body and a disc-shaped cover closing one end of the cylindrical body. The cover includes an overhanging rim about the cylindrical body. Gun powder is present inside the cylindrical body of the cap and the other end of the cylindrical body is pinched closed so as to keep moisture out of the gun powder and thus provide "waterproofing".

The present invention embodies a new nipple structure shaped to accept and fire the new waterproof percussion cap of the previous description. Because of the structure of the waterproof cartridge cap, the new nipple has been shaped with a wide bore duct to accept the cap inside the nipple instead of fitting the cap over the end of the nipple as was done with the prior art nipples and bucket-shaped caps, and a small bore duct or vent passage extending from the wide bore duct into the breech of the gun barrel. The new nipple structure also includes a firing ridge or protrusion which, in conjunction with the gun hammer, ignites the cartridge-shaped cap.

The old style nipple of a muzzle-loaded firearm is removed and the new nipple screwed into the internally threaded hole of the breech of the barrel of the firearm. When the firearm is to be fired, the gun powder is inserted into the barrel and one of the new cartridge-shaped caps is inserted into the nipple. The hammer hitting the cover of the cartridge-shaped cap drives the firing ridge of the nipple into the rim of the cover, causing the gun powder in the cylindrical body of the cap to ignite and thus fire the charge.

It is, therefore, an object of the present invention to provide a nipple for use in muzzle loaded firearms which can be used to fire a waterproof, cartridge-shaped percussion cap.

It is another object of this invention to provide a combinaton of a new nipple structure and a firing cap for use in firing muzzle-loaded firearms.

Other objects, features and advantages of this invention will become apparent upon reading the following specification and claims and upon considering the accompanying drawing.

BRIEF DESCRIPTION OF THE DRAWINGS

FIG. 1 is a perspective view of a prior art nipple and its related bucket-shaped percussion cap.

FIG. 2 is an exploded perspective view of the new nipple according to the invention as used in conjunction with a cartridge-shaped percussion cap and muzzle loaded firearm.

DETAILED DESCRIPTION

Referring now to the drawings, FIG. 1 shows an old style nipple 10 constructed for use in conjunction with the old style bucket-shaped percussion cap 11. The old style nipple 10 possesses a uniform diameter hollow passage 12 extending axially through the nipple. The nipple 10 had a threaded portion 13 for securing the nipple into the breech 15 of the gun 16 (see FIG. 2). The bucket-shaped cap 11, containing a small quantity of gun powder (not shown) fits over the nipple 10 with the protruding portion 17 of the nipple passing inside the bucket-shaped cap 11. The bucket-shaped cap 11 has one covered end 18 but its other end 19 is open to the elements.

FIG. 2 shows the new type nipple 22 of the present invention to be used in conjunction with a waterproof cartridge-shaped percussion cap 23.

The cartridge-shaped percussion cap 23 has the general shape of the rear portion of the shell of a 22-caliber cartridge. The percussion cap 23 has a cylindrical body 33 which is covered and sealed at one end by a cover piece 34 having an annular rim 35 which overhangs the cylindrical body 33. The other end 37 of the cylindrical body 33 is pinched shut so as to create a relatively waterproof seal to protect the small quantity of gun powder (not shown) which is held within the cartridge-shaped percussion cap 23.

The nipple 22 is generally bolt-shaped with a lower externally threaded shank portion 25 for securing the nipple into the internally threaded bore of the breech 15 of a gun 16. The lower externally threaded portion 25 of nipple 22 defines a narrow, uniform diameter internal counter bore vent passage 26 extending axially through it. The upper or head portion 27 of the new nipple 22 functions as the cartridge or cap cradling portion 27. This cradling portion 27 has a wide bore duct 29 extending axially through it which communicates with the vent passage 26 of the threaded portion 25 to form a continuous passage axially through the nipple structure 22. The duct 29 has an inside diameter slightly larger than the cylindrical body 33 of the cartridge-shaped percussion cap 23. The vent passage 26 is substantially smaller in diameter than the cradling duct 29. The upper external end of the nipple 22 is formed in an annular upper edge 31 about the wide bore duct 29, and a firing ridge or protrusion 30 extends upwardly from the upper edge 31 of the cradling portion 27.

In operation, the nipple 22 is threaded into the breech 15 of the gun 16 with the open end of the vent passage 26 exposed to the black powder charge within the gun barrel. The cartridge or cap cradling portion 27 of the nipple 22 protrudes from the gun 16 and the cartridge-shaped percussion cap 23 is set inside the duct 29 with its pinched end 37 first. The rim 35 of the cover piece 34 rests on the upper edge 31 and firing ridge 30 of the invented nipple 22. The gun hammer 39 hitting the cover piece 34 of the cartridge cap 23 drives the firing ridge 30 into the rim 35 of the cap 23 creating a spark, causing the cap to ignite and thus forcing fire through the vent passage 26 into the black powder charge in the gun barrel. The resulting explosion forces the bullet from the barrel.

It will be understood that a particular embodiment of the invention is shown by way of illustration only, and other embodiments of the same invention are equally encompassed, as described in the accompanying claims.

What is claimed is:

1. A generally bolt-shaped firing nipple for use with a rimmed, cylindrical, cartridge-shaped powder-bearing percussion cap in muzzle loading firearms, said nipple comprising:

a cap cradling portion, said cradling portion including a duct defined axially therethrough having an internal diameter sufficient to accept the outside diameter of said cylindrical body of said percussion cap within said duct;

an externally threaded portion being an extension of said cap cradling portion for insertion into the breech of a muzzle loading gun, said threaded portion including an open-ended vent passage extending axially therethrough, said vent passage having an inside diameter substantially smaller than the diameter of said duct;

said cap cradling portion including at its end opposite to said externally threaded portion an annular upper edge against which the rim of said cartridge shaped percussion cap rests;

a firing ridge formed on said upper edge;

whereby a cartridge-shaped percussion cap is inserted into said cradling portion of said nipple with the rim of said cap resting on said flat upper edge and said cap rim being held slightly off one section of said upper edge by said firing ridge such that when contact is made against the back of said cartridge cap, said firing ridge is driven into said cap rim, igniting the powder within said cap which sends flame through said vent passage into the powder load of said gun thus igniting said powder.

2. In a muzzle loaded firearm, the combination of a firing nipple for threading into the breech of the firearm and a percussion cap for inserting into the nipple for use in igniting the powder charge of the firearm, said percussion cap comprising a cylindrical body with one end thereof pinched closed and a cover piece covering and sealing its other end, said cover piece including an annular rim overhanging said cylindrical body; and a generally bolt-shaped nipple comprising:

a cap cradling portion, said cradling portion including a duct defined axially therethrough having an internal diameter sufficient to accept the outside diameter of said cylindrical body of said percussion cap within said duct;

an externally threaded portion being an extension of said cap cradling portion for insertion into the breech of a muzzle loading gun, said threaded portion including an open-ended vent passage extending axially therethrough, said vent passage having an inside diameter substantially smaller than the diameter of said duct;

said cap cradling portion including at its end opposite to said externally threaded portion an annular upper edge against which said annular rim of said percussion cap rests;

a firing ridge formed on said upper edge;

whereby said percussion cap is inserted into said cradling portion of said nipple with the rim of said cap resting on said flat upper edge and said cap rim being held slightly off one section of said upper edge by said firing ridge such that when contact is made against the cover piece of said cap, said firing ridge is driven into said annular cap rim, igniting said cap which sends flame through said vent passage into the powder load of said gun thus igniting said powder.

* * * * *